United States Patent [19]

Kawano et al.

[11] Patent Number: 4,985,736

[45] Date of Patent: Jan. 15, 1991

[54] IMAGE FORMING APPARATUS

[75] Inventors: Hisaaki Kawano, Kawasaki; Yasufumi Tanimoto, Fujisawa, both of Japan

[73] Assignee: Kabushiki Kaisha Toshiba, Kawasaki, Japan

[21] Appl. No.: 224,721

[22] Filed: Jul. 27, 1988

[30] Foreign Application Priority Data

Jul. 31, 1987 [JP] Japan ..... 62-191570

[51] Int. Cl.[5] ..... G03G 21/00

[52] U.S. Cl. ..... 355/311; 355/309

[58] Field of Search ..... 355/200, 210, 243, 308, 355/309, 311

[56] References Cited

U.S. PATENT DOCUMENTS 4,260,241 4/1981 Honma et al. ..... 355/271
4,719,489 1/1988 Ohkubo et al. ..... 355/290
4,839,695 6/1989 Yamamoto et al. ..... 355/243 X

FOREIGN PATENT DOCUMENTS 2300144 7/1973 Fed. Rep. of Germany .
3320734 12/1983 Fed. Rep. of Germany .

*Primary Examiner*—Fred L. Braun
*Attorney, Agent, or Firm*—Foley & Lardner, Schwartz, Jeffery, Schwaab, Mack, Blumenthal & Evans

[57] ABSTRACT

A image forming apparatus has a first paper sheets supply system for supplying first paper sheets to a transfer section and a second paper sheets supply system for supplying second paper sheets to the transfer section. Either of the first and second paper sheets supply systems is selected in response to information applied from a control section. Information of paper sheet supply intervals set for the first and second paper sheets supply systems is stored in a memory. When the second paper sheets supply system is selected by the control section in the course of continuously supplying paper sheets through the first paper sheets supply system, a new second paper sheet is supplied through the second paper sheets supply system in accordance with the information of paper sheet supply interval set for the first paper sheets supply system and a next second paper sheet and its following ones are supplied through the second paper sheets supply system in accordance with the information of paper sheet supply interval set for the second paper sheets supply system.

6 Claims, 7 Drawing Sheets

IMAGE FORMING APPARATUS

BACKGROUND OF THE INVENTION

1. Field of the Invention

The present invention relates to an image forming apparatus such as the laser beam printer and the copying machine.

2. Description of the Related Art

In the case of the laser beam printer recently developed, such laser beam as corresponds to image signals is lead onto the pre-charged surface of the photosensitive drum to form an electrostatic latent image thereon. This latent image is developed by toner. A toner image is thus formed on the photosensitive drum. This toner image is transferred onto a sheet of paper at the transfer section.

When the efficiency of forming images successively is to be enhanced in the case of this laser beam printer, it is important how the interval of forming images one after another or the timing of supplying paper sheets one after another is set. Conventionally, the supply of a next paper sheet to the transfer section has already started before its previous paper sheet is discharged from the printer. When the paper sheets supply is switched to another paper sheets supply system in the course of the continuous images forming operation, however, a new paper sheet is supplied after the previous paper sheet is discharged from the printer. It is therefore impossible to supply paper sheets at an optimum quick timing from the switched paper sheets supply system. This causes the images forming efficiency to become low.

SUMMARY OF THE INVENTION

The object of the present invention is to provide a image forming apparatus capable of supplying paper sheets at an optimum quick timing through all paper sheets supply systems to thereby enhance its continuous images forming efficiency.

According to an aspect of the present invention, there can be provided an image forming apparatus comprising image-forming means for continuously forming images on sheet of paper, first paper-feeding means for feeding sheet of paper to the image-forming means, for a first paper-feeding distance, second paper-feeding means for feeding sheets of papers to the image-forming means, for a second paper-feeding distance different from the first paper-feeding distance, selection means for selecting either the first paper-feeding means or the second paper-feeding means while the image-forming means is continuously forming image, timing-determining means for determining the start timings of the first and second paper-feeding means in accordance with the first and second paper-feeding distances, before the selection means selects either the first paper-feeding means or the second paper-feeding means, and driver means for driving either the first paper-feeding means or the second paper-feeding means in accordance with the start timings determined by the timing-determining means.

According to the present invention, a paper sheets supply timing is previously set for every paper sheet supply system. When a paper sheets supply system is switched to another one in the course of the continuous images forming operation, the paper sheets supply from the new paper sheets supply system starts at that paper sheets supply timing which is set for the previous paper sheets supply system, thereby enabling paper sheets to be supplied at an optimum quick timing.

DETAILED DESCRIPTION OF THE PREFERRED EMBODIMENT

An embodiment of the present invention will be described with reference to the accompanying drawings.

Figure 1:
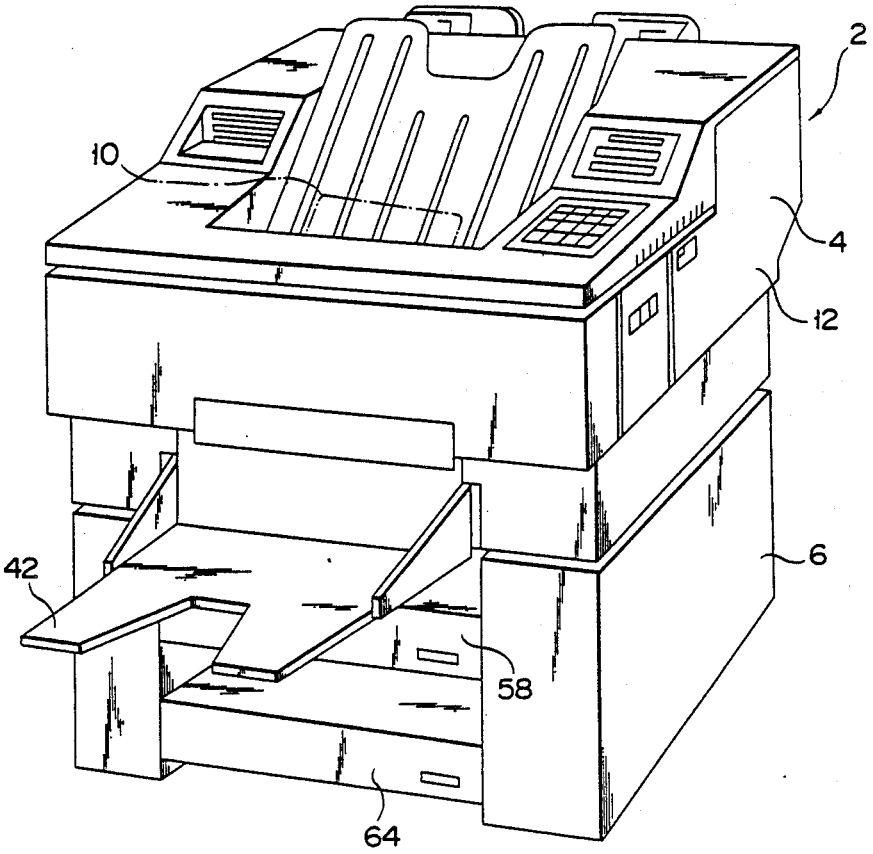
FIG. 1 is a perspective view showing the whole of the image forming apparatus according to the present invention.
Figure 2:
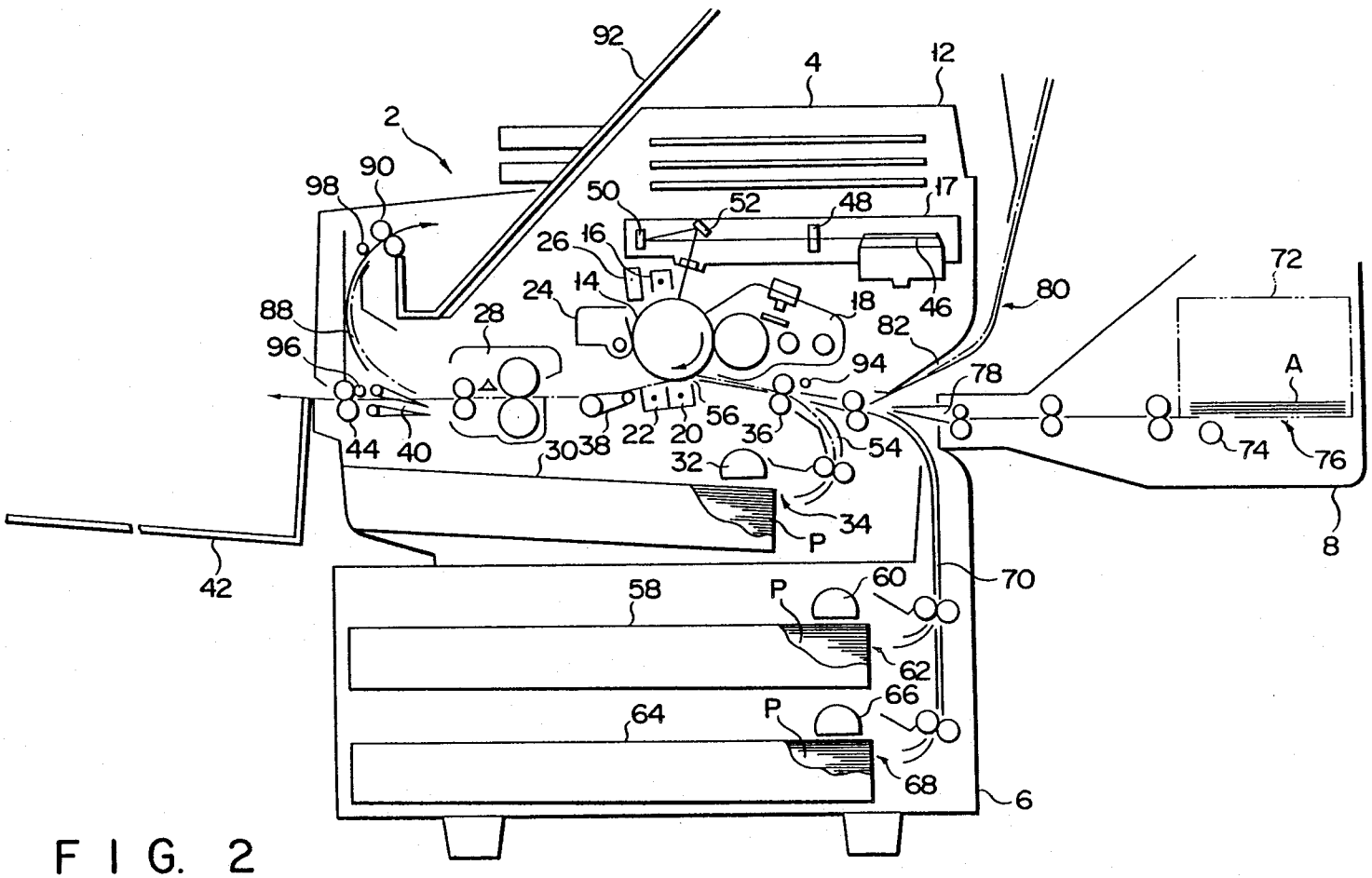
FIG. 2 is a side view showing the inside of the images forming apparatus in FIG. 1.

In FIGS. 1 and 2, numeral 2 represents an image forming apparatus to which an example of the paper sheets supply device according to the present invention is applied. This image forming apparatus 2 has laser beam printer 4. Multi-cassette feeder 6 for feeding thin common paper sheets P into printer 4, envelope feeder 8 for feeding thick paper sheets A such as envelopes into printer 4, jogger 10 serving as a distributor for distributing every predetermined number of image formed paper sheets P or A, and the like are connected, as optional means, to laser beam printer 4. Multi-cassette feeder 6, envelope feeder 8 and jogger 10 are on line with a control section (which will be described later) in housing 12 of laser beam printer 4.

There are arranged in laser beam printer 4 a process line including photosensitive drum 14 rotated in a predetermined direction, charger 16 for charging the surface of photosensitive drum 14, laser optical system 17 for introducing laser beam which includes image information onto that surface of photosensitive drum 14 which has been charged by charger 16 to thereby form an electrostatic latent image thereon, developing means 18 for developing the electrostatic latent image on photosensitive drum 14 with toner to form a toner image thereon, transfer means 20 for transferring this toner image from photosensitive drum 14 onto paper sheet P or A, separator means 22 for separating paper sheet P or A which has contacted with photosensitive drum 14 at the time when the toner image is transferred, cleaning means 24 for removing the toner which has not been transferred onto paper sheet P or A but remained on photosensitive drum 14, means 26 for removing the charge from the surface of photosensitive drum 14 after it is cleaned, and means 28 for fixing the toner image on paper sheet P or A; first paper sheets supply system 34 including paper sheets supply cassette 30 in which paper sheets P are housed, and roller 32 for feeding paper sheets P from paper sheets supply cassette 30; a pair of aligning rollers 36 for aligning paper sheets P or A and feeding them to photosensitive drum 14; conveyer belt 38 for conveying toner-image-transferred paper sheet P or A to fixing means 28; gate 40 for guiding fixed paper sheet P or A in the horizontal direction or upward; and a pair of rollers 44 for discharging paper sheet P or A which has been guided in the horizontal direction onto tray 42. Laser optical system 17 includes a semiconductor laser generator (not shown) for generating laser beam which contains image information, a collimator lens (not shown) for collimating this laser beam, polygon mirror 46 for scanning this collimated laser beam, f.$\theta$ lens 48 for correcting the distortion of this scanned laser beam and mirrors 50 and 55 for introducing this corrected laser beam onto the surface of photosensitive drum 14.

The laser beam which corresponds to image signals applied from an external means (shown in FIG. 3) and which is sent through laser optical system 17 is imaged on the surface of photosensitive drum 14 at the time of image forming operation. Photosensitive drum 14 rotates in a direction shown by an arrow in FIG. 2, its surface is charged by charger 16 and then exposed in response to the image signals applied through laser optical system 17, so that an electrostatic latent image can be formed on its surface. This electrostatic latent image is made visible when it is developed with toner by developing means 18.

Paper sheets P in paper sheets supply cassette 30 are picked up one by one by feeding roller 32, guided to aligning rollers 36, passing through passage 54, and fed to transfer section 56 by aligning rollers 36.

Multi-cassette feeder 6 includes second paper sheets supply system 62 provided with paper sheets supply cassette 58 in which paper sheets P are housed, and roller 60 for feeding paper sheets P one by one from paper sheets supply cassette 58. Multi-cassette feeder 6 also includes third paper sheets supply system 68 provided with paper sheets supply cassette 64 in which paper sheets P are housed, and roller 66 for feeding paper sheets P one by one from paper sheets supply cassette 64. Paper sheet P fed from second or third paper sheets supply system 62 or 68 is guided to aligning rollers 36, passing through passage 70. Envelope feeder 8 includes fourth paper sheets supply system 76 provided with stacker 72 in which paper sheets A, such as envelopes, are housed, and roller 74 for feeding paper sheets A one by one from stacker 72. Paper sheet A fed from fourth paper sheets supply system 76 are guided to aligning rollers 36, passing through passage 78. Manual paper sheets supply section 80 is located on one side of printer 4, serving as a fifth paper sheets supply system. Paper sheet P manually fed through this manual paper sheets supply section 80 is guided to aligning rollers 36, passing through passage 82. First through fifth paper sheets supply systems 34, 62, 68, 76 and 80 supply paper sheets P or A responsive to paper-sheet-specifying signals applied from external means 84 or operation panel 86 and paper sheets thus supplied are fed to transfer section 56.

Paper sheet P or A fed to transfer section 56 is closely contacted with the surface of photosensitive drum 14 at transfer section 56 and a toner image is transferred onto photosensitive drum 14 by the action of transfer means 20. This image-transferred paper sheet P or A is separated from photosensitive drum 14 by separator means 22 and conveyed by conveyer means 38 to fixing means 28 where the transferred image is fixed on it. Image-fixed paper sheet P or A is guided to discharging rollers 44 or passage 88 through gate 40. Paper sheet P or A fed to discharging rollers 44 is discharged on tray 42 through these paired discharging rollers 44. Paper sheet P or A fed to passage 88 is discharged on tray 92 by a pair of discharging rollers 90, said tray being supported freely movable by jogger 10.

Toner remaining on photosensitive drum 14 is removed by cleaning means 24 and any residual image thereon is then removed by charge removing means 26 after the image transfer operation, thereby making photosensitive drum 14 ready for a next image forming operation.

Switch 94 for detecting that paper sheets p or A are mistakenly fed to transfer section 56 through aligning rollers 36 is located on the upper side of aligning rollers 36 when viewed in the paper sheets feeding direction. Switches 96 and 98 for detecting paper sheets supply errors caused through discharging rollers 44 and 90 are also located on the upper side of discharging rollers 44 and 90 when viewed in the paper sheets feeding direction.

Figure 3:
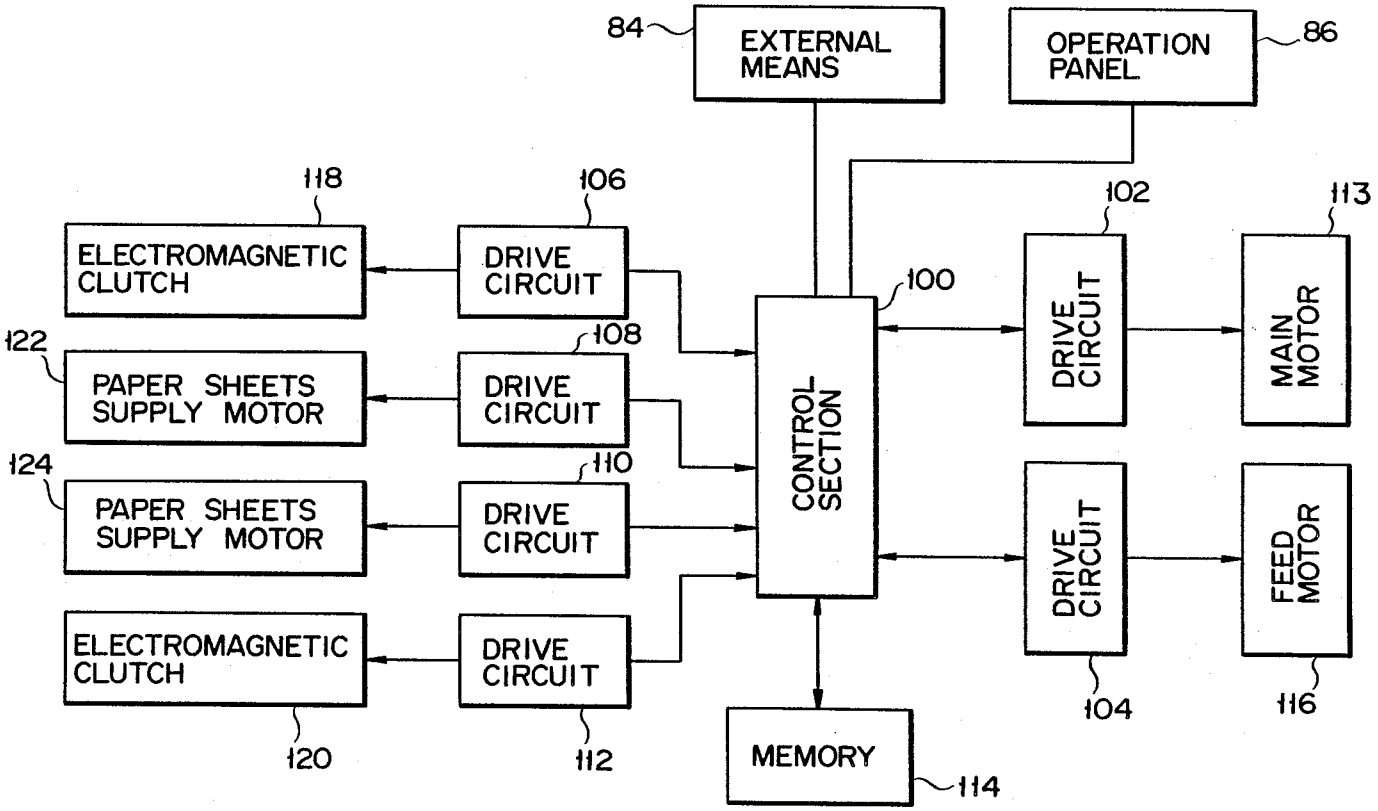
FIG. 3 is a block diagram intended to explain an electric circuit for use in the apparatus shown in FIG. 1.

Numeral 100 in FIG. 3 represents a control section, which transmits and receives signals to and from external means 84 or operation panel 86 and controls driver circuits 102–112 responsive to signals applied from external means 84. Main motor 113, feed motor 116, electromagnetic clutches 118, 120, and paper sheets supply motors 122, 124 are thus driven to control multicassette feeder 6, envelope feeder 8, jogger 10, laser optical system 17, charger means 16, developing means 18, charge removing means 26, aligning rollers 36, feeding rollers 32, 60, 66, 74, separator means 22, fixing means 28, cleaning means 24, gate 40 and the like, so that the above-described image forming operation can be carried out. The supply of a next paper sheet P or A is controlled at the same time in response to data values (or paper sheet supply timings) stored in memory 114, thereby enabling the image forming operation to be carried out successively.

Driver circuits 106–112 selectively drive electromagnetic clutches 118, 120 and paper sheets supply motors 122, 124 in response to control signals applied from control section 100. Paper sheets supply systems 34, 62, 68 and 76 are thus rendered operative in accordance with instructions applied from external means 84 or operation panel 86. When electromagnetic clutch 118 is driven in this case, first paper sheets supply system 34 is made operative. Paper sheets P are thus picked up one by one from paper sheets supply cassette 30 by means of feeding roller 32 and guided to aligning rollers 36. When second paper sheets supply system 62 is made operative by motor 122, for example, paper sheet P fed from paper sheets supply cassette 58 by feeding roller 60 is guided to aligning rollers 36. When third paper sheets supply system 68 is made operative by motor 124, for example, paper sheet P fed from paper sheets supply cassette 64 by feeding roller 66 is guided to aligning rollers 36. When fourth paper sheets supply system 76 is rendered operative by electromagnetic clutch 120, for example, paper sheet A fed from stacker 72 by feeding roller 74 is guided to aligning rollers 36.

When paper sheet P is inserted by hand into manual paper sheets supply section 80, for example, which serves as the fifth paper sheets supply system, it is automatically guided to aligning rollers 36.

Figure 4:
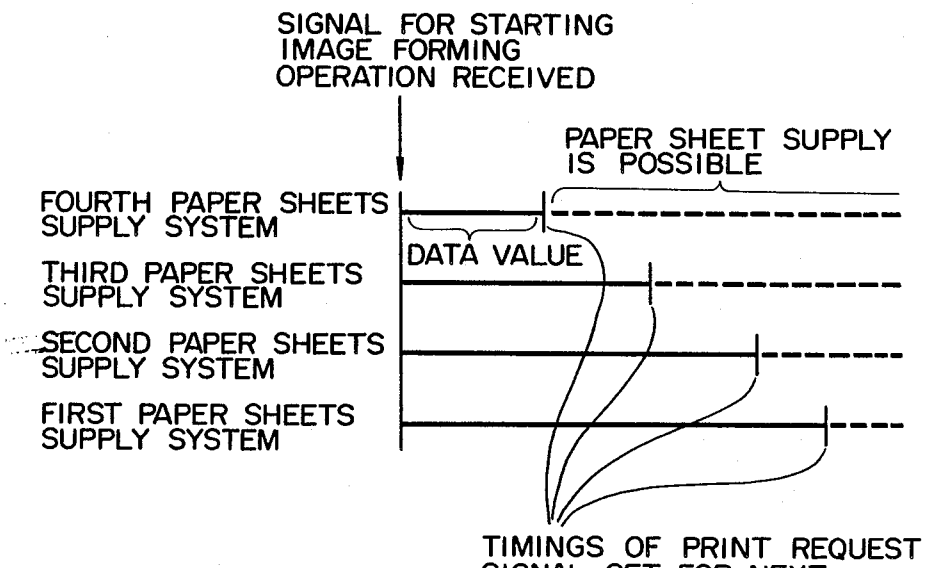
FIG. 4 shows an example of print request timer data stored in a memory of the electric circuit shown in FIG. 3.

Print request timer data by which timings of supplying paper sheets to continuously carry out the image forming operation are determined are stored in memory 114, corresponding to each of first through fourth paper sheets supply systems 34, 62, 68 and 76, as shown in FIG. 4. These data values are different from one another, depending upon distances along which the paper sheets must be fed, and sizes of the paper sheets fed. The data value represents a paper sheet supply timing most suitable for its corresponding one of paper sheets supply systems 34, 62, 68 and 76 at the time when the image forming operation is being continuously carried out. Namely, it denotes the shortest time period starting from the reception of that signal (or VSYNC command) which is applied from external means 84 or operation panel 86 to start the image forming operation and ending with the supply of a paper sheet for a next image forming operation. Timers are of the software type.

Control section 100 controls first paper sheets supply system 34 for example in response to instructions applied from external means 84 or operation panel 86. First paper sheets supply system 34 becomes operative in this case, causing paper sheet p to be picked up from cassette 30 by feeding roller 32 and guided to aligning rollers 36. When the signal for starting the image forming operation relative to paper sheet P is received under this state from external means 84 by control section 100, print request timers of paper sheets P or A are set in memory 114, relating to all of paper sheets supply systems 34, 62, 68 and 76. The print request timer for first paper sheets supply system 34 set in memory 114 is observed by control section 100 since the signal for starting the image forming operation has been received. A next paper sheet supply timing is thus determined. When the print request timer for first paper sheets supply system 34 is over in this case, next paper sheet P becomes ready to be supplied. When this timer is over, therefore, print request signal (or PREQ) for requesting the start of next paper sheet P is applied from control section 100 to external means 84, thereby enabling next paper sheet P to be quickly supplied.

Figure 5A:
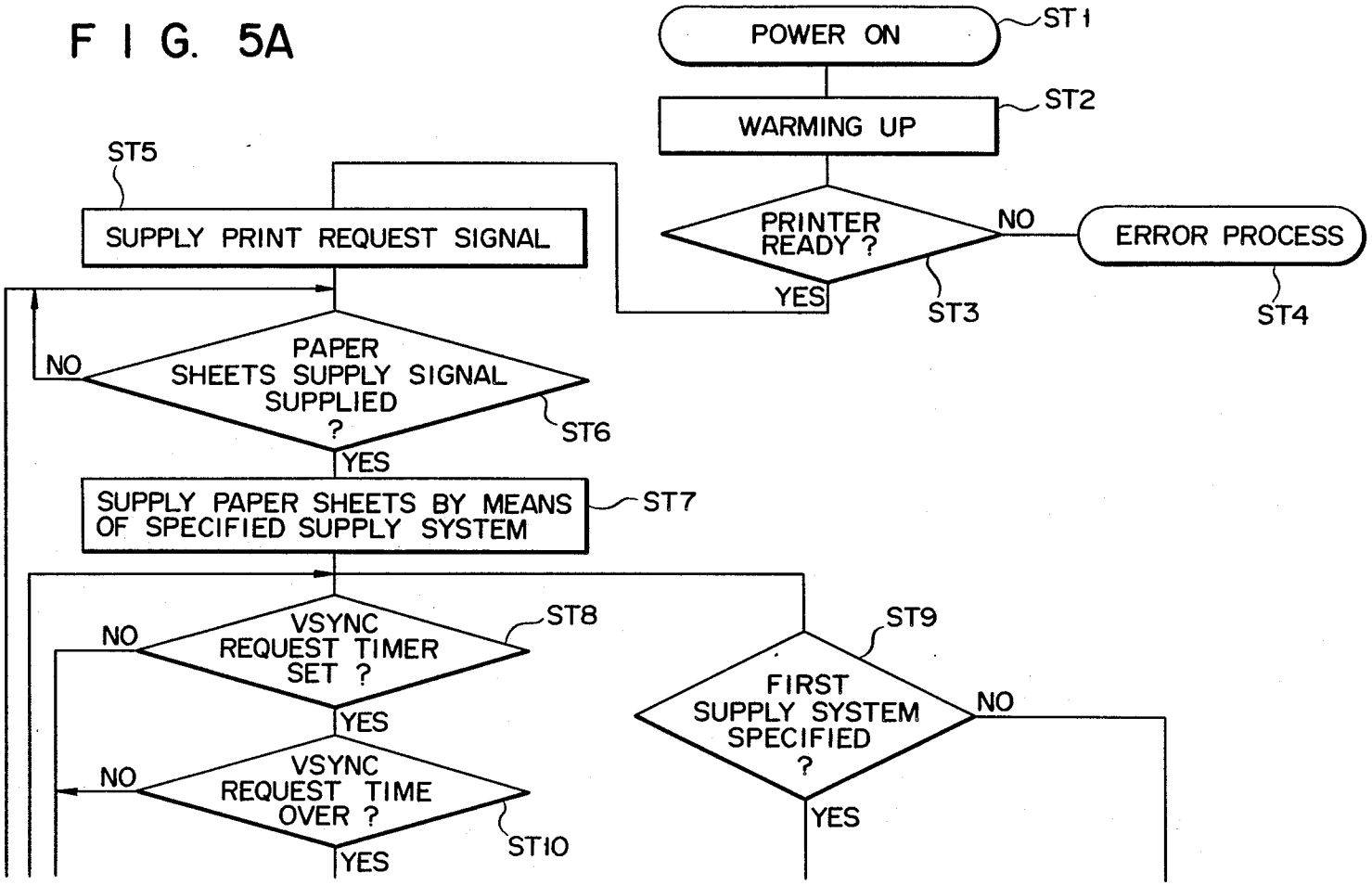
FIGS. 5A and 5B show a flow chart intended to explain the operation of the apparatus shown in FIG. 1.
Figure 5B:
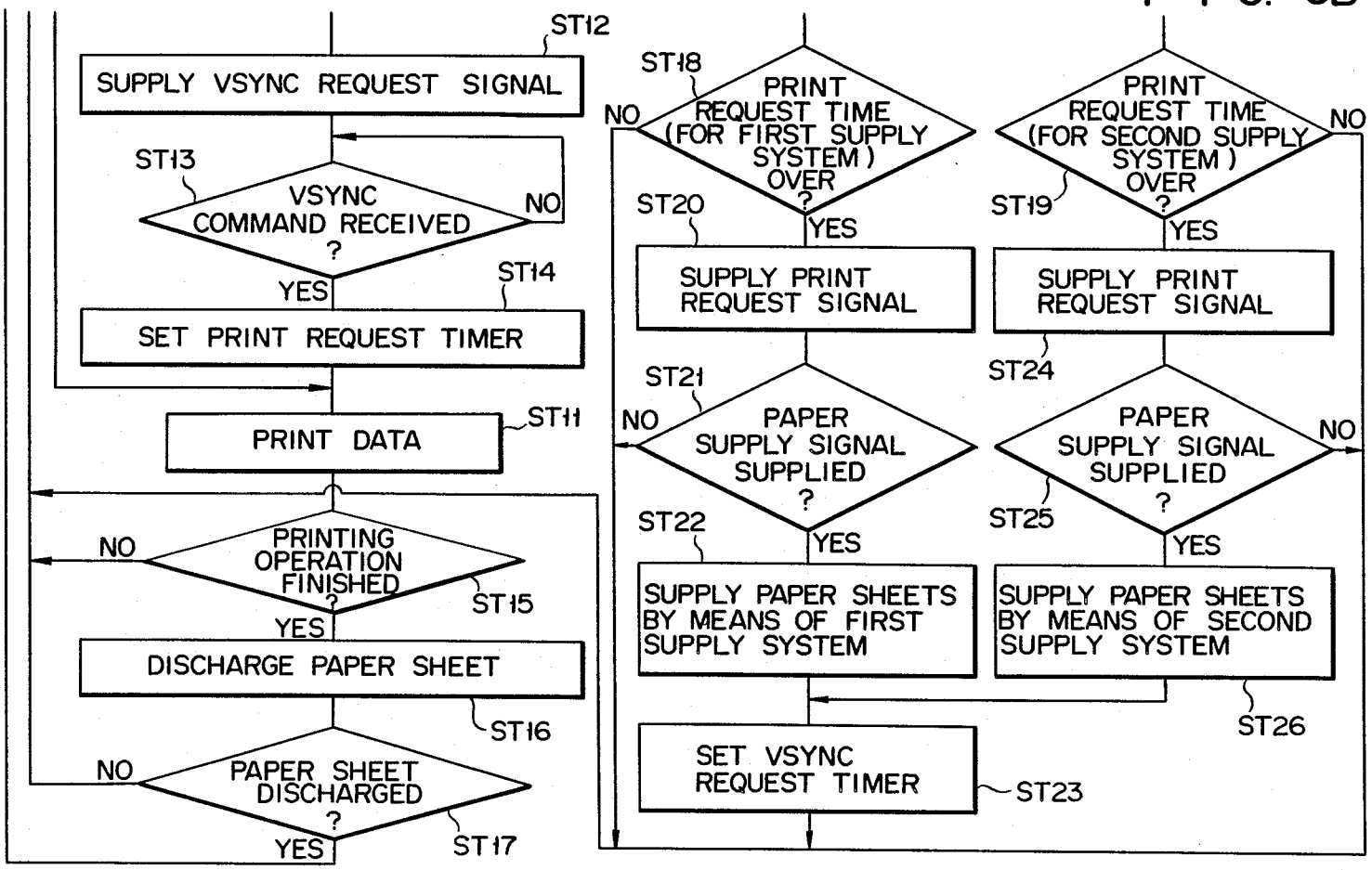
Figure 6:
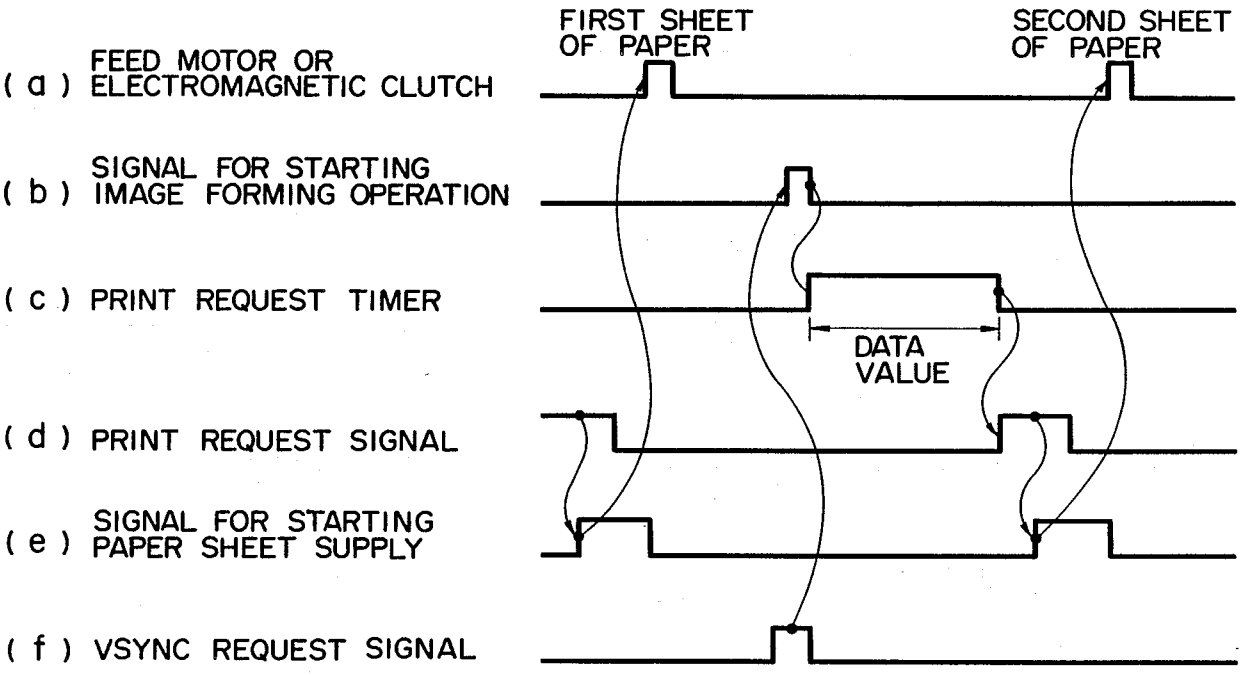
FIG. 6 is a timing chart intended to explain the operation of the apparatus shown in FIG. 1.

The above-described image forming operation repeated will be described referring to flow and timing charts shown in FIGS. 5A, 5B and 6. The description will be made only about the case where first and second paper sheets supply systems 34 and 62 are used.

When the apparatus is turned on at step ST1, the process advances to step ST2.

The apparatus is warmed up at step ST2 and the process proceeds to step ST3.

It is confirmed at step ST3 whether or not the apparatus is under such condition that the image can be formed and when it is not under such condition, the process advances to step ST4, while when it is under such condition, the process advances to step ST5.

Errors are processed at step ST4.

The print request signal is supplied from external means 84 to control section 100 at step ST5. The process then advances to step ST6.

It is judged at step ST6 whether or not the paper sheet specifying signal for selecting either of paper sheets supply systems 34 and 62 and the start signal of paper sheets supply are supplied from external means 84 to control section 10. When it is judged that they have been supplied, the process proceeds to step ST7.

Paper sheets are supplied by specified paper sheets supply system 34 or 62 at step ST7. The process then advances to steps ST8 and ST9.

It is judged at step ST8 whether or not VSYNC request timer is set. When it is set, the process advances to step ST10. When it is not set, the process advances to step ST11.

It is judged at step ST10 whether or not VSYNC request time is over. When it is over, the process advances to step ST12. When it is not over, the process advances to step ST11.

VSYNC request signal is supplied from control section 100 to external means 84 at step ST12. The process then advances to step ST13.

It is judged at step ST13 whether or not control section 100 receives VSYNC command (or signal for starting the image forming operation) from external means 84. When VSYNC command is received, the process proceeds to step ST14.

The print request timer is set at step ST14. The process then advances to step ST11.

Laser optical system 17, charger means 16, developing means 18 and the like are drive-controlled at step ST11. The printing or image forming operation is thus started relative to the first paper sheet. The process advances to step ST15.

It is judged at step ST15 whether or not the printing operation is finished. When it is finished, the process advances to step ST16. When it is not finished, the process advances to steps ST8 and ST9.

Paper sheet P is discharged at step ST16. The process then proceeds to step ST17.

It is judged at step ST17 whether o not the discharging operation of paper sheet P is finished. When it is finished, the process advances to step ST6. When it is not finished, the process advances to steps ST8 and ST9.

It is judged at step ST9 whether or not first paper sheets supply system 34 is specified. When it is specified, the process advances to step ST18. When it is not specified, the process advances to step ST19.

It is judged at step ST18 whether or not the print request time for first paper sheets supply system 34 is passed. When it is passed, the process advances to step ST20. When it is not passed, the process advances to steps ST8 and ST9.

The print request signal is supplied from control section 10 to external means 84 at step ST20. The process advances to step ST21.

It is judged at step ST21 whether or not the signal for starting the paper sheets supply is applied from external means 84 to control section 100. When it has been applied, the process proceeds to step ST22. When it has not been applied yet, the process advances to steps ST8 and ST9.

First paper sheets supply system 34 is driven at step ST22. The process then advances to step ST23.

VSYNC request timer is set at step ST23. The process then advances to steps ST8 and ST9.

It is judged at step ST19 whether o not the print request time for second paper sheets supply system 62 is passed. When it is passed, the process advances to step ST24. When it is not passed, the process advances to steps ST8 and ST9.

The print request signal is applied from control section 100 to external means 84 at step ST24. The process then advances to step ST25.

It is judged at step ST25 whether or not the signal for starting the paper sheets supply is applied from external means 84 to control section 100. When it has been applied, the process advances to step ST26. When it has not been applied, the process advances to steps ST8 and ST9.

Second paper sheets supply system 62 is driven at step ST26. The process advances to step ST23.

More specifically, it is assumed that the paper sheet specifying signal for selecting either of paper sheets supply systems 34 and 62 and the image signal are outputted from external means 84. Drive signal is supplied from control section 100 to each of drive circuits 102–112. Main motor 113 and electromagnetic clutches 118, 120 or paper sheets supply motors 122, 124 are selectively driven by drive circuits 102–112. Paper sheets supply system 34, 62, 68 or 76 which corresponds to the paper sheet specifying signal is thus made operative and paper sheet P or A is guided from paper sheets supply system 34, 62, 68 or 76 to aligning rollers 36. When control section 100 receives the signal for starting the image forming operation from external means 84 in response to its transmission of VSYNC request signal, control signal is supplied from control section 100 to drive circuit 104. Drive circuit 104 thus drives feed motor 116. First paper sheet P or A is therefore fed to transfer section 56 by aligning rollers 36.

When the signal for starting the image forming operation (or VSYNC command) applied from external means 84 is received under this state by control section 100, each of laser optical system 17, charger means 16, developing means 18 and the like is controlled in response to main motor 113 driven by control section 100. The image forming operation is thus started relative to first paper sheet P or A and the print request timer for paper sheets supply system 34, 62, 68 or 76 through which first paper sheet P or A is fed is observed by control section 100 to determine the timing of supplying next paper sheet P or A. Namely, the print request timer for paper sheet P or A on which the image is being formed is observed by control section 100. When this timer is over, signal (or print request signal) for asking the supply start of next paper sheet P or A is applied to external means 84.

Paper sheet (or second one) P or A which meets the paper sheet specifying signal applied from external means 84 is picked up from predetermined paper sheets supply system 34, 62, 68 or 76 for a next image forming operation and guided to aligning rollers 36. When the signal (or IPRINT) for starting the paper sheets supply which responds to the print request signal is received by control section 100, second paper sheet P or A is fed to transfer section 56 by aligning rollers 36.

Paper sheets supply system 34, 62, 68 or 76 is switched to another one responsive to the paper sheet specifying signal applied from external means 84 in the course of the image forming operation, for example, paper sheet P or A which meets the paper sheet specifying signal is supplied at the previously determined timing. The supply of next paper sheet is carried out in this case in accordance with the timing (or set timing of the print request signal) at which next paper sheet P or A can be supplied in response to that image forming operation which is being applied to previous paper sheet P or A. Namely, the supply of next paper sheet is carried out regardless of the size of paper sheets housed in switched paper sheets supply system 34, 62, 68 or 76.

The supply control of next paper sheet P or A will be hereinafter carried out at the shortest timing as described above, thereby enabling the image forming operation to be repeated at a higher efficiency.

When first paper sheets supply system 34 is switched to second one 62 in the course of continuously supplying paper sheets P from cassette 30 of first paper sheets supply system 34 at the certain interval (or at the data value for first paper sheets supply system 34 shown in FIG. 4), for example, first paper sheet P is supplied from cassette 58 of second paper sheets supply system 62 at the data value for first paper sheets supply system 34 shown in FIG. 4 and second and its following paper sheets P will be supplied at the data value for second paper sheets supply system 62 shown in FIG. 4.

As described above, next paper sheet supply timings are previously set corresponding to all of paper sheets supply systems 34, 62, 68 and 76 and when paper sheets supply system 34, 62, 68 or 76 is switched to another one in the course of repeating the image forming operation, the supply of a next paper sheet from switched paper sheets supply system 34, 62, 68 or 76 is started at the timing set for that paper sheets supply system which was under operation before it is switched to another one, thereby enabling the supply of a next paper sheet to be achieved at the most optimum and quickest timing.

The print request timer set for those paper sheets to which the image forming operation is being applied is observed, the signal (or print request signal) for asking the supply of next paper sheet P or A to be started is controlled on its output timing and applied to external means 84, and the supply of next paper sheet P or A is started responsive to the signal for asking the start of paper sheet supply. The supply of a next paper sheet can be thus carried out at the shortest interval, corresponding to each of sizes of the paper sheets which are now to be supplied instead of those paper sheets P or A which are being subjected to the image forming operation, even in the course of repeating the image forming operation. Even when paper sheets supply system 34, 62, 68 or 76 is switched to another one in the course of repeating the image forming operation, the print request timer set for paper sheets P or A which are under the image forming operation is observed to enable the supply of a next paper sheet to be achieved at the most optimum and quickest timing, so that operation efficiency can be enhanced in the course of repeating the image forming operation.

What is claimed is:

1. An image forming apparatus comprising:

image-forming means for continuously forming images on sheet of paper;

first paper-feeding means for feeding sheet of paper to said image-forming means, over a first paper-feeding distance;

second paper-feeding means for feeding sheets of papers to said image-forming means, over a second paper-feeding distance different from said first paper-feeding distance;

selection means for selecting either said first paper-feeding means or said second paper-feeding means while said image-forming means is continuously forming an image;

memory means for determining the start timings of said first and second paper-feeding means in accordance with the first and second paper-feeding distances, before said selection means selects either said first paper-feeding means or said second paper-feeding means; and driver means for driving either said first paper-feeding means or said second paper-feeding means in accordance with the start timings determined by said memory means.

2. The image forming apparatus according to claim 1, wherein said driver means has a means for driving said second paper-feeding means to start the feed of its paper sheets in response to the start timing of said first paper-feeding means when said second paper-feeding means is selected by said selection means in the course of continuously feeding paper sheets through said first paper-feeding means.

3. The image forming apparatus according to claim 1, wherein said driver means has a means for driving said second paper-feeding means to make the shortest the interval of feeding the second paper sheets through said second paper-feeding means, when said second paper-feeding means is selected by said selection means in the course of continuously feeding paper sheets through said first paper-feeding means.

4. The image forming apparatus according to claim 1, wherein the start timings of said first and second paper-feeding means are determined depending upon the distance along which paper sheets are fed from said first paper-feeding means to the image-forming means, the distance along which paper sheets are fed from second paper-feeding means to the image-forming means, and sizes of said first and second paper sheets.

5. The image-forming apparatus of claim 1, wherein more than two paper-feeding means are provided, the memory means determining the start timings of each paper-feeding means in accordance with the lengths of the paper-feeding paths.

6. An image forming apparatus comprising: image-forming means for continuously forming images on sheets of paper;

first paper-feeding means for feeding sheets of paper to said image-forming means over a first paper-feeding distance;

second paper-feeding means for feeding sheets of papers to said image-forming means over a second paper-feeding distance different from said first paper-feeding distance;

selection means for selecting either said first paper-feeding means or said second paper-feeding means while said image-forming means is continuously forming an image;

memory means for determining the start timings of said first and second paper-feeding means in accordance with the first and second paper-feeding distances, before said selection means selects either said first paper-feeding means or said second paper-feeding means; and driver means for driving either said first paper-feeding means or said second paper-feeding means in accordance with the start timings determined by said memory means;

wherein said driver means has a means for driving said second paper-feeding means to feed a new second paper sheet in accordance with the start timing of said first paper-feeding means and to feed a next second paper sheet and its following second paper sheets in accordance with the start timing of said second paper-feeding means, when said second paper-feeding means is selected by said selection means in the course of continuously supplying paper sheets through said first paper sheets supply means.

* * * * *